United States Patent [19]

Andrews

[11] Patent Number: 4,827,675

[45] Date of Patent: May 9, 1989

[54] METHOD AND APPARATUS FOR FORMING A CURVED SLOT

[75] Inventor: Laurance R. Andrews, Granby, Conn.

[73] Assignee: United Technologies Corporation, Hartford, Conn.

[21] Appl. No.: 71,700

[22] Filed: Jul. 9, 1987

[51] Int. Cl.[4] ..... B24B 19/14

[52] U.S. Cl. ..... 51/281 R; 51/96; 51/105 R; 51/124 R; 51/131.1; 51/209 R; 415/139; 415/189

[58] Field of Search ..... 51/33 R, 55, 96, 97 R, 51/99, 105 R, 108 R, 124 R, 131.1, 134, 206 R, 207, 209 R, 237 R, 237 T, 240 T, 281 R; 29/23.5, 156.8 B; 415/139, 189, 190

[56] References Cited

U.S. PATENT DOCUMENTS

| | | | |
|---|---|---|---|
| 1,830,952 | 11/1931 | McMullen et al. | 51/33 R |
| 1,830,971 | 11/1931 | Taylor | 51/33 R |
| 2,099,674 | 11/1937 | Bullock et al. | 51/52 |
| 2,183,699 | 12/1939 | Schweiker | 51/105 R X |
| 2,367,850 | 1/1945 | Dusevoir | 51/281 |
| 2,515,695 | 7/1950 | Caston | 51/237 T X |
| 2,807,914 | 10/1957 | Pascal et al. | 51/33 |
| 2,839,873 | 6/1958 | Baxter, Jr. | 51/33 |
| 2,873,557 | 2/1959 | Markle | 51/33 |
| 3,213,567 | 10/1965 | King et al. | 51/33 R X |
| 3,282,263 | 11/1966 | Christensen et al. | 125/15 |
| 3,315,415 | 4/1967 | Lannom | 51/97 |
| 3,680,263 | 8/1972 | Johnson | 51/96 |
| 3,777,443 | 12/1973 | Shaw | 51/206.5 |
| 3,803,767 | 4/1974 | Kotov et al. | 51/33 R |
| 3,816,995 | 6/1974 | Borchert, III | 51/96 |
| 3,902,277 | 9/1975 | Rupp | 51/33 W |
| 4,016,683 | 4/1977 | Cretella | 51/143 |
| 4,067,701 | 1/1978 | Horvath et al. | 51/33 R |
| 4,115,956 | 9/1978 | Huffman | 51/96 |
| 4,279,102 | 7/1981 | Hennenfent et al. | 51/231 R X |
| 4,339,895 | 7/1982 | Fivian | 51/287 |
| 4,379,560 | 4/1983 | Bakken | 416/95 X |
| 4,505,075 | 3/1985 | Salmon et al. | 29/156.8 B |
| 4,545,154 | 10/1985 | Sekiya et al. | 51/209 R |
| 4,567,694 | 2/1986 | Sekiya et al. | 51/209 R |

FOREIGN PATENT DOCUMENTS

| | | | |
|---|---|---|---|
| 22002 | 2/1985 | Japan | 415/139 |

*Primary Examiner*—Robert P. Olszewski

[57] ABSTRACT

A dish-shaped wheel having an essentially slot-shaped conically extending cutting tip with the tip extending angularly from the wheel surface. The tip includes a super abrasive plating suitable for nondressable cutting such as cubic boron nitride. The wheel is of sufficient diameter to cut an ellipse approximating the arc to be formed as the wheel moves in an arc through the article. The apparatus further includes mechanism for orienting the wheel, mechanism for rotating the wheel and mechanism for translating the wheel or the article in a desired arc for producing a curved slot. The apparatus has particular application for producing narrow curved featherseal slots in turbine vane platforms, allowing increased complexity in vane design while enhancing seal integrity.

9 Claims, 3 Drawing Sheets

1
2
3
4
5
6
7
8
9
10
11

METHOD AND APPARATUS FOR FORMING A CURVED SLOT

TECHNICAL FIELD

This invention relates to a method and apparatus for forming curved slots, and more particularly, for creep feed grinding a curved featherseal slot in a turbine vane platform.

BACKGROUND ART

Turbine vane platforms in a single stage of a gas turbine engine are sealed vane-to-vane with featherseals which are retained in essentially smooth sided slots. Featherseals generally comprise thin, high temperature resistant metal strips placed between adjacent vane platforms in corresponding slots, with the ends of the slots blocked to ensure seal retention (see FIG. 6). While the featherseals must be thin enough to bend and seal during radial vane movement, it is essential that the seal edges continuously engage an essentially smooth surface to prevent gas seepage through gaps between the seal edge and the contacted slot wall. Such gas seepage between vane stages reduces overall turbine efficiency.

Featherseal slots are very narrow, on the order of 0.02–0.30 inches wide, with general practice in the industry to provide straight slots in the vane platforms utilizing conventional machining techniques. However, most vane platforms have curved end sections for aerodynamic efficiency. Consequently, these curved end sections must include additional metal to provide adequate material for including a straight slot, which adds to engine weight, reducing the thrust to weight ratio. Such a slot is illustrated by the phantom lines on FIG. 4. In addition to the additional metal and weight added to the vane, the slot, since it does not follow the optimal aerodynamic contour, is more prone to leakage, thereby reducing engine efficiency. While many turbine vane designs can accommodate the additional metal requirement, advanced vane designs, utilizing a relatively flat vane profile, cannot. Consequently, these advanced vanes have not been deemed practical as no method existed for providing a good vane-to-vane seal.

Producing curved slots using conventional techniques is impractical. As a conventional "friable" wheel removes metal, it breaks down and requires frequent truing and dressing to maintain its cutting power, particularly when grinding superalloy material. The wheel diameter and width consequently vary during the cut, producing a relatively irregular slot wall. In addition, the wheel must be replaced after cutting one or two slots. Attempts have also been made to provide curved featherseal slots utilizing electrical discharge machining (EDM). However, an EDM electrode does not remain sufficiently flat to produce a smooth slot wall with an air-sealable surface. Consequently, the search continues for a method and apparatus for providing relatively reproducible, curved featherseal slots in airfoil articles.

DISCLOSURE OF INVENTION

According to the present invention, an apparatus is disclosed for providing a curved, essentially smooth slot in an airfoil article comprising a dish-shaped wheel having an essentially slot-shaped cutting tip, with the tip extending angularly from the wheel surface in an amount sufficient to provide a particular slot radius. The tip includes a super abrasive grit which is suitable for nondressable cutting. The wheel is of a sufficient diameter to minimize cutback as the wheel moves in an arc through the article. The apparatus also includes means for orienting the wheel such that the cutting tip is perpendicular to the article to be slotted, and, means for rotating the wheel at speeds sufficient to provide abrasion of the article and removal of sufficient metal to form a slot in the article. In addition, means are provided for translating the wheel or article in a particular arc for producing a curved slot of a desired radius.

The method for providing a curved, essentially smooth slot in an airfoil article comprises, providing a dish-shaped wheel having an essentially slot-shaped cutting tip with the tip extending angularly from the wheel surface, the tip including a super abrasive plating for nondressable cutting, with the wheel of a sufficient diameter to minimize cutback as the wheel moves in an arc through the article. The next step involves orienting the wheel such that the cutting tip is perpendicular to the article to be slotted and then rotating the wheel at speeds sufficient to abrade the article and remove sufficient metal to form a curved slot, with the article translated relative to the wheel in a particular arc for producing a curved slot of a desired radius.

BEST MODE FOR CARRYING OUT THE INVENTION

Figure 1:
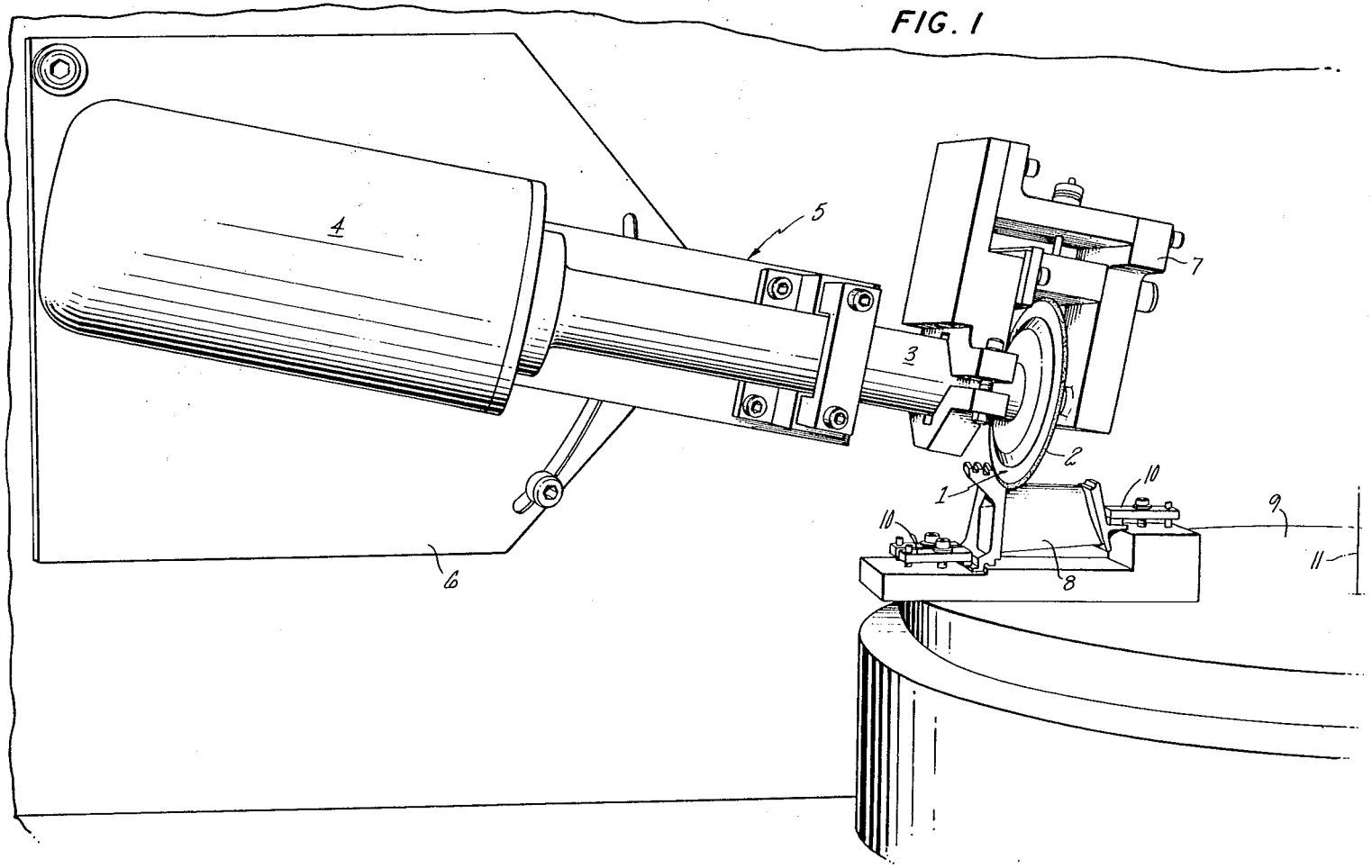
FIG. 1 illustrates an apparatus for creep feed grinding curved featherseal slots.

Referring to FIG. 1, an apparatus for forming curved slots is shown. For purposes of this discussion, a "curved slot" is defined as a pair of curved, generally flat parallel walls with a relatively flat bottom, providing a generally curved rectangular opening. Such slots may be very narrow, on the order of 0.02–0.30" wide. A dish-shaped wheel 1, including a slot shaped tip 2, is attached to a high speed spindle 3 which is driven by a variable speed electric motor 4, forming a spindle-motor assembly 5. A "slot-shaped tip" is defined as one having approximately the same width and depth as the desired slot, producing a pair of curved, generally flat parallel walls with a relatively flat bottom. The spindle-motor assembly 5 is mounted on a rotary coupling 6 for providing adjustment of the spindle angle. While a rotary coupling is shown, any orientation means for directing the slot-shaped tip 2 into perpendicular orientation relative to a workpiece may be used. In addition, the spindle may be orientable in a number of dimensions such as up/down, forward/back, with a forwardly tilting angular displacement capability of at least 50°, with up to about 90° possible. The spindle-motor assembly 5 also includes a cooling collar 7 for cooling the wheel 1 during grinding.

Referring still to FIG. 1, A turbine vane 8 is fixedly disposed on a rotary table 9 which allows circular translation of the vane under the wheel 1. The table may also be movable in several dimensions, such as up/down, forward/back, or tilt, for ease of orientation. Of course, using an appropriate cone angle, the choice of a particular combination of orientation features between the table and spindle is user selectable. The rotary table 9 includes clamps 10 or other fixturing means for fixing the vane at a desired radius from a centerline 11 of the rotary table. Of course, increasing the radius reduces the curvature of the slot, and decreasing the radius increases the curvature. While a particular embodiment is illustrated in FIG. 1, many types of machining centers may be adapted to utilize this invention. For example, both horizontal and vertical machining centers having high speed spindles may be used. In addition, those having automated features, such as in process gaging, automatic tool changing and automatic pallet changing are particularly desirable to reduce machining time.

Figure 2:
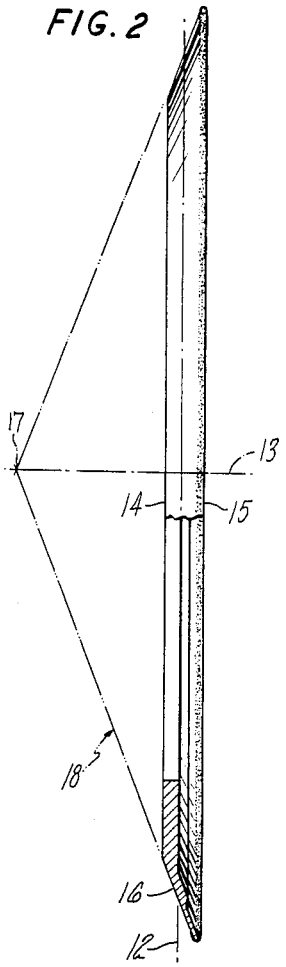
FIG. 2 illustrates the details of a dish-shaped super abrasive machining wheel for providing a curved slot.
Figure 3:
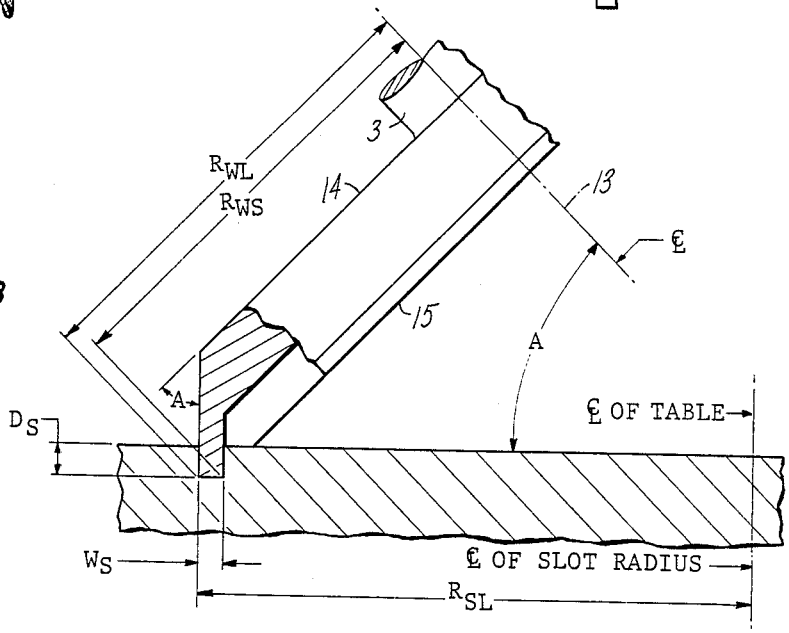
FIG. 3 illustrates a typical airfoil vane including a curved featherseal slot.
Figure 6:
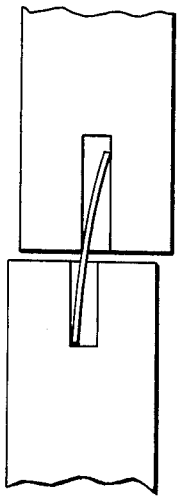
FIG. 6 is a cross-sectional view of a featherseal disposed in opposed slots in a pair of turbine vane platforms, illustrating a vane to vane seal.

Referring to FIG. 2, the details of a particular dish-shaped wheel are shown. The wheel 1 includes a longitudinal axis 12 and has a central axis 13. The inner and outer wheel surfaces, 14 and 15 respectively, define the inner and outer wheel diameters, with a tip angled surface 16 therebetween. These diameters are designed for a particular application by first determining the desired slot depth, slot width and slot radius. FIG. 3 illustrates the critical parameters where $R_{wl}$ equals largest radius of wheel, $R_{ws}$ equals smallest radius of wheel, $D_s$ equals slot depth, $W_s$ equals slot width, $R_{sl}$ equals largest slot radius and A equals a cone or tip angle. The cone angle refers to a phantom extension of the tip angled surface 16 to a phantom apex 17. In essence, the disk shaped wheel forms the base of a phantom cone 18. A minimum cutback (T), illustrated in exaggerated fashion in FIG. 6, occurs as the forward and rearward edges of the curved wheel tip are moved in an arc through the workpiece. This cutback or tolerance can be minimized by careful sizing of the wheel diameters and precise setting of the cone angle. Consequently, the various disk design parameters must be balanced to achieve a smooth reproducible slot. Each wheel is therefore uniquely designed for producing a slot of a particular radius and depth.

The following formulas are used to determine the proper wheel dimensions for producing an essentially smooth slot:

$$R_{wl} = \frac{(2 \times Y)^2 + H^2 \times 4}{8 \times H}$$

where $$H = \frac{D_s}{\text{Cosine } A}$$

$$Y = \sqrt{R_{sl}^2 - (R_{sl} - D_s \times \text{Tan } A)^2}$$

$$R_{ws} = R_{wl} - (W_s \times \text{sine } A)$$

Figure 5:
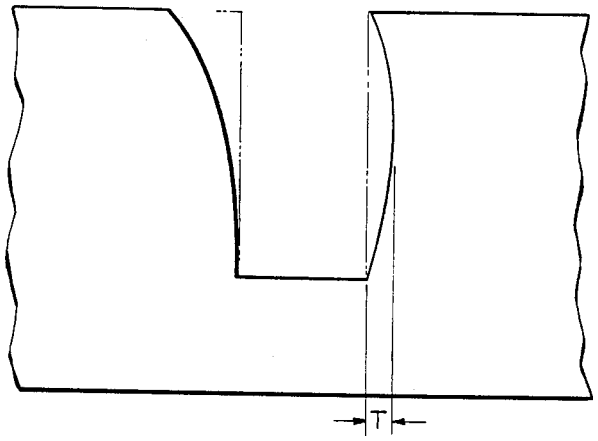
FIG. 5 is an enlarged exaggerated view of a typical slot.

As an illustration, for a wheel having a tip at a cone angle A of 9°16", and a workpiece requiring a slot having a depth of 0.375 inches, width of 0.136 inches, with a maximum cutback T of 0.002 inches and a slot radius of 18.1 inches, the $R_{wl}$ equals 3.10 and the $R_{ws}$ equals 3.08. The degree of cutback is determined by multiple iterations of the depth for a given tip angle. As shown in FIG. 5, the wheel cuts a different slot width at each slot depth, producing a slightly concave slot wall. Consequently, by repeated calculation, the cutback or difference in width may be determined. It should be noted that a flat wall is not essential to providing a good seal. Rather, the smoothness of the longitudinal wall engaging the seal edges determines whether a good seal is obtained. For a given wheel diameter, a plurality of particular slots could be produced by varying the tip angle, see Table I.

TABLE I

For a 6" diameter wheel and a T of 0.002 inches.

| A | $R_{sl}$ Inches | $W_s$ Inches | $D_s$ Inches |
|---|---|---|---|
| 8°6' | 18.804 | 0.200 | 0.335 |
| 8°22" | 19.034 | 0.238 | 0.185 |
| 9°38' | 18.279 | 0.135 | 0.220 |
| 14°17' | 11.920 | 0.024 | 0.150 |
| 29°15' | 6.024 | 0.024 | 0.125 |

In operation, the dish-shaped wheel tip is plated with a superabrasive grit material such as cubic boron nitride (CBN), for example, to a thickness of 0.003 inches by any conventional plating method. Superabrasive grit is required to provide relative permanence to the slot shape during nondressable cutting, and is particularly suited for cutting such difficult materials as cobalt, nickel and iron base superalloys. While CBN is exemplary, it will be understood by those skilled in the art that any superabrasive material such as diamond may be used. The superabrasive material may be of any desired grit, with 200–230 grit preferred for the narrow slot widths. The wheel is then attached to a high speed orientable spindle capable of rotating the wheel up to about 10,000 rpm.

The turbine vane is fixed to the rotary table at a particular radius from the table centerline. The spindle and wheel are then driven to a particular speed and the vane translated in an arc into continuous contact with the wheel. The wheel may be rotatable at a speed sufficient to allow creep feed grinding of the slot, with the slot formed in one pass. For example, the vane may be moved at 1–2 inches per minute along the desired arc produced.

EXAMPLE

Figure 4:
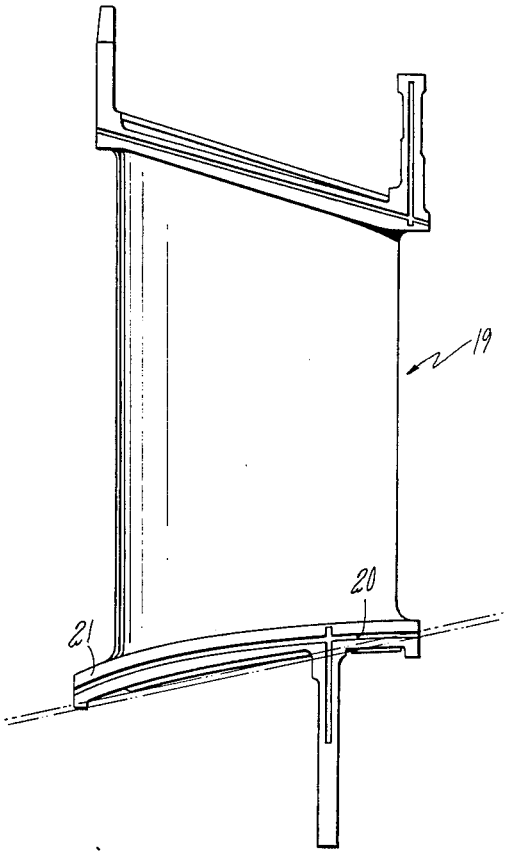
FIG. 4 is a view of a slot illustrating the critical wheel sizing parameters, with an illustrative straight slot shown in phantom.

Referring to FIG. 4, an airfoil vane 19 made of a cobalt base superalloy, having a nominal composition of 23.4 Cr, 10.0 Ni; 0.2 Ti, 0.6 C, 7.0 W, 3.5 Ta, Balance Co, requires a curved featherseal slot 20 to be cut in a vane platform 15, with the slot having a slot depth ($D_s$) of 0.120 inches, a slot width ($W_s$) of 0.024 inches at a slot radius of 6.024 inches, with a maximum allowable cutback (T) of 0.002 inches. A wheel having a radius ($R_{wl}$) of 3 inches, tip width of 0.022 inches and an angle (A) of 29°15'is prepared and plated with 200/230 grit CBN. The wheel is attached to an orientable spindle manufactured by Whitman Spindle Division GMN, which utilizes a sandwich hub for locking the wheel to the spindle and incorporates a cooling system for cooling both the vane and the wheel.

The vane is attached to a rotary table with the proposed slot location fixed at the 6.024 inch radius from the table centerline. The vane is then rotated into contact with the wheel which is spinning at about 5800 rpm to achieve a tip speed of about 9000 surface feet per minute (SFPM), with the table rotating the vane at a radial speed at the slot zone of between 1 and 2 inches per minute. As the vane moves through contact with the wheel, a curved featherseal slot is cut in the vane platform to the required dimensions.

While this invention has been described in relation to curved featherseal slots for use in turbine vane platforms, it will be understood by those skilled in the art that any article requiring a curved, essentially smooth slot could utilize this invention. This invention is particularly suited for providing narrow slots on the order of 0.02 inches wide in superalloy articles. Utilizing this method and apparatus, advanced vane designs having complex platform shapes may be efficiently sealed, significantly advancing turbine design and enhancing engine operation. For example, in one vane application, utilizing a curved featherseal slot allowed a 0.145 inch thickness reduction in the vane platform, effecting a substantial weight savings. Consequently, previously unobtainable gas turbine aerodynamic performance may be obtained without sacrificing seal integrity.

It should be understood that the invention is not limited to the particular embodiments shown and described herein, but that various changes and modification may be made without departing from the spirit and scope of this novel concept as defined by the following claims.

I claim:

1. An apparatus for providing a curved essentially smooth slot in an airfoil article comprising:

a dish-shaped wheel having a conically extending essentially slot-shaped cutting tip, the tip extending angularly from the wheel surface, the tip including a super abrasive grit plating suitable for nondressable cutting;

means for orienting said wheel such that the cutting tip is substantially perpendicular to the article to be slotted whereby a slot of conical section is formed;

means for rotating the wheel at speeds sufficient to provide abrasion of the article and removal of sufficient metal to form a slot in the article; and means for translating the wheel with respect to the article in an arc for producing a curved slot of a radius approximating the conical section formed by said wheel at a fixed location, said means for translating the wheel with respect to the article comprising;

a rotatable table which includes means for fixing the article at a desired radius from a centerline of the table.

2. A method of providing an arcuate, essentially smooth slot in an airfoil article, comprising:

rotating a grinding wheel having a conically extending essentially slot-shaped cutting tip around the axis of said wheel, the tip extending angularly from the wheel surface, the tip including a super abrasive grit plating suitable for nondressable cutting, the wheel having sufficient inner and outer diameters to minimize cutback as the wheel moves in an arc through the article;

orienting the wheel such that the cutting tip is substantially perpendicular to the article to be slotted, and penetrating the material to the desired depth of the slot, whereby a conical section slot portion is formed; and translating the rotating wheel with respect to the article in an arc approximating the formed conical section for producing a curved slot of a desired radius.

3. The method of claim 2 wherein the tip extends at an angle less than 50° from the face of said wheel.

4. The method of claim 2 further characterized by fixing the article at a desired radius from the centerline of a rotatable table prior to translating the article.

5. The method of claim 2, also comprising:

selecting a desired slot radius ($R_{s1}$);

selecting a desired slot depth ($D_s$);

selecting an available cone angle (A); and forming said grinding wheel of a radius ($R_{w1}$) where $H=D_s/\text{cosine } A$, $Y=\sqrt{R_{s1}^2-(R_{s1}-D_s \text{ TanA})^2}$, and $R_{w1}=(Y^2+H^2)/2H$.

6. The method of claim 2, wherein the step of translating the grinding wheel comprises:

translating the grinding wheel with respect to the article in an arc such that the cut at the maximum penetration centerline of wheel intersects at least a portion of the conical section cut from the article at a fixed wheel position, throughout all portions of said conical section.

7. The method of claim 2 comprising:

orienting said wheel with the cutting tip precisely perpendicular to the surface of the article at the maximum wheel penetration centerline.

8. The method of claim 6 comprising:

orienting said wheel with the cutting tip precisely perpendicular to the surface of the article at the maximum wheel penetration centerline.

9. The method of claim 2, wherein the step of translating the grinding wheel comprises:

translating the grinding wheel with respect to the article in an arc having a radius greater than the offset distance in the plane of the surface of the article from the tip to the centerline of rotation of said grinding wheel.

* * * * *